US008087546B2

(12) United States Patent
Rabinovitch

(10) Patent No.: US 8,087,546 B2
(45) Date of Patent: Jan. 3, 2012

(54) DISPENSER FOR CONTAINING AND DISPENSING A LIQUID OR POURABLE SOLID PRODUCT

(76) Inventor: Dan Rabinovitch, Toronto (CA)

( * ) Notice: Subject to any disclaimer, the term of this patent is extended or adjusted under 35 U.S.C. 154(b) by 652 days.

(21) Appl. No.: 12/259,443

(22) Filed: Oct. 28, 2008

(65) Prior Publication Data

US 2010/0102086 A1 Apr. 29, 2010

(51) Int. Cl.
*B65D 35/56* (2006.01)

(52) U.S. Cl. ..... 222/183; 222/105; 222/500

(58) Field of Classification Search ..... 222/105, 222/183, 567, 500
See application file for complete search history.

(56) References Cited

U.S. PATENT DOCUMENTS

| | | | | |
|---|---|---|---|---|
| 2,113,048 | A * | 4/1938 | Gross | 222/482 |
| 2,554,570 | A * | 5/1951 | Harvey | 222/207 |
| 2,828,054 | A * | 3/1958 | Chiaramonte | 222/479 |
| 2,991,897 | A * | 7/1961 | Burnett | 215/21 |
| 3,965,953 | A | 6/1976 | Becker et al. | |
| 3,968,907 | A | 7/1976 | Nix, nee Saxler | |
| 4,473,174 | A | 9/1984 | Heuser | |
| 4,955,512 | A | 9/1990 | Sharples | |
| 4,984,711 | A | 1/1991 | Ellis | |
| 5,249,714 | A * | 10/1993 | Merhar | 222/500 |
| 5,579,945 | A | 12/1996 | Ichikawa et al. | |
| 5,601,211 | A | 2/1997 | Foster | |
| 5,911,345 | A * | 6/1999 | Castleberry | 222/482 |
| 5,967,379 | A | 10/1999 | Crossdale et al. | |
| D446,420 | S | 8/2001 | Donnell | |
| 7,802,703 | B2 * | 9/2010 | Kiser | 222/500 |
| 2005/0029285 | A1 * | 2/2005 | Gay et al. | 222/1 |
| 2008/0142545 | A1 | 6/2008 | Priolo et al. | |

FOREIGN PATENT DOCUMENTS

| | | | |
|---|---|---|---|
| EP | 1302408 | A1 | 4/2003 |
| FR | 775479 | | 12/1934 |
| WO | W02008091149 | A1 | 7/2008 |

OTHER PUBLICATIONS

International Search Report with respect to International Application No. PCT/US2009/048371.

* cited by examiner

*Primary Examiner* — Kevin P Shaver
*Assistant Examiner* — Donnell Long
(74) *Attorney, Agent, or Firm* — Caesar, Rivise, Bernstein, Cohen & Pokotilow, Ltd.

(57) ABSTRACT

A dispenser is provided for containing and dispensing a liquid or pourable solid product. The dispenser includes a shell having a bottom and a continuous side wall, which together define a hollow cavity. A lid assembly covers the rigid shell and includes a central opening. A flexible pouch is arranged for locating within the hollow cavity and for containing the product to be dispensed. The flexible pouch includes a pouring spout having an outlet opening. The pouring spout is arranged for extending through the lid assembly opening when the flexible pouch is situated within the hollow cavity. The lid assembly additionally includes a set of clamping members positioned to surround the pouring spout. The clamping members are responsive to actuation and arranged to move from a retracted position to a clamping position to prevent movement of the pouring spout when situated within the opening.

8 Claims, 10 Drawing Sheets

FIG.2
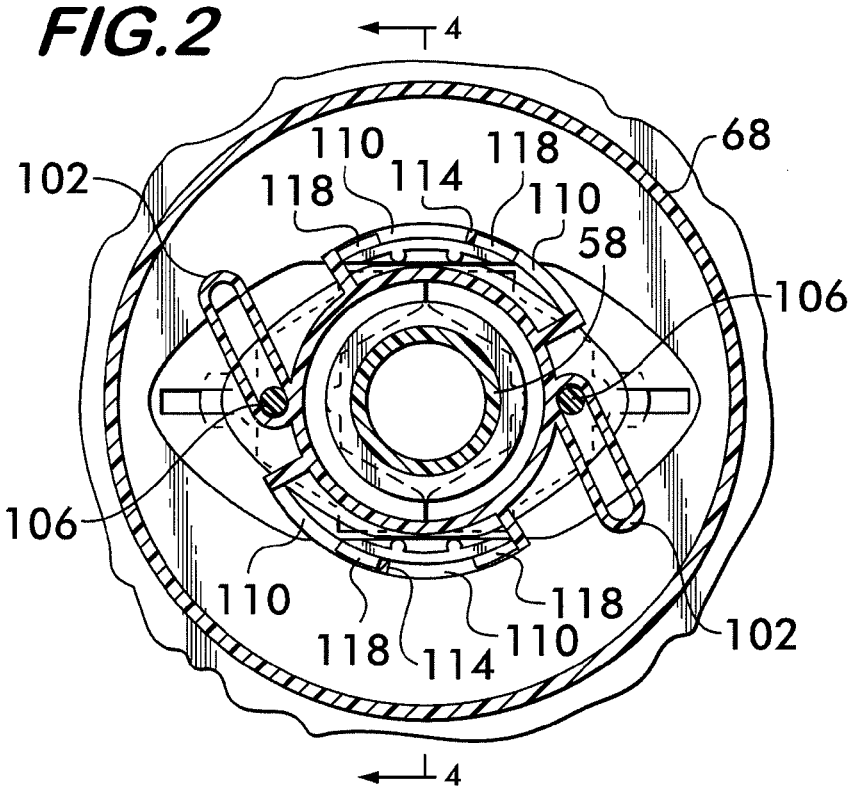
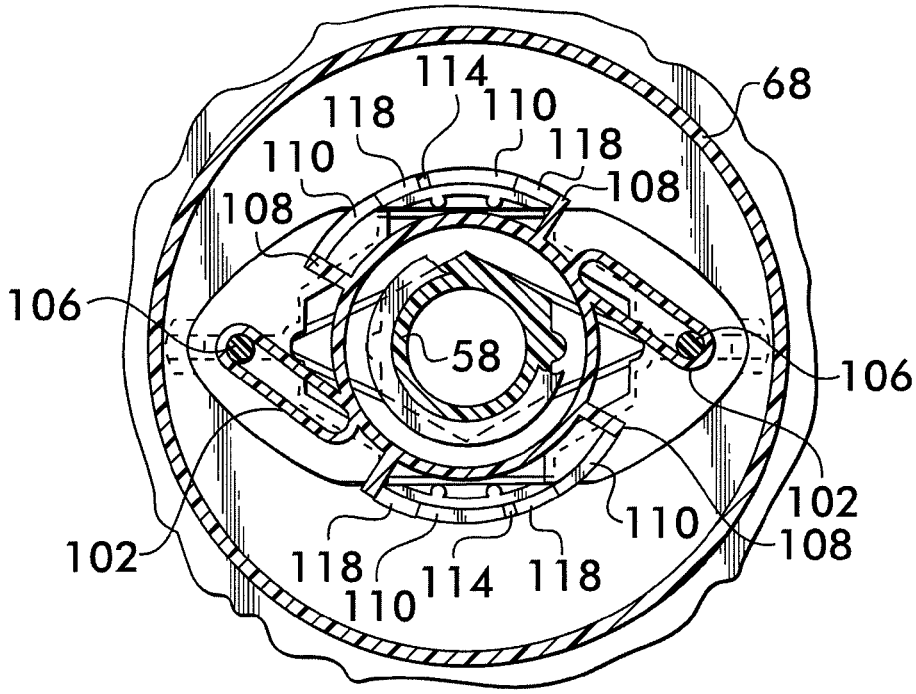
FIG.3

DISPENSER FOR CONTAINING AND DISPENSING A LIQUID OR POURABLE SOLID PRODUCT

FIELD OF THE INVENTION

The present invention relates generally to a dispenser for dispensing a liquid or pourable solid product therefrom. More particularly, the present invention relates to a dispenser having an attractive exterior carafe and a functional clamping mechanism that simplifies use.

BACKGROUND OF INVENTION

Increased environmental awareness by the consuming public has created a substantial commercial incentive for retailers to adopt environmentally friendly practices. One such practice is the reduction of packaging-related waste. Specifically, retailers are now seeking to stock their shelves with products having packaging that is bio-degradable, recyclable or generally reduced in volume from traditional packaging. For example, the wine industry has begun to see a plethora of brands sold in paper-based packaging that is recyclable.

One of the most promising packaging types to achieve the goal of reducing waste is the flexible stand-up pouch. Long used to package goods such as pet food and gardening products, the stand-up pouch has in recent years begun to appear in grocery store food aisles for such products as chips, cookies, and croutons.

It has been discovered that the self-standing flexible pouch may be used for high value liquid consumables such as wine (although the scope of his invention extends well beyond that one category, to any pourable liquid or solid product). The benefits to the consumer for this type of package include that it is shatter-proof, lightweight and has a far lower impact on the environment than standard glass bottles.

There are, however, difficulties that can arise when using this type of packaging for wine. First, the aesthetics of the package may be detrimental to the image of the wine brand, since the flexible stand-up pouch may seem less attractive to consumers than a bottle. Second, the stand-up pouch, because of its flexible nature, can be more difficult than a bottle to grip firmly, and the use of a pouch may result in more frequent spillage. Third, the stand-up pouch is typically not insulated, and may thus allow the wine to lose its chill more quickly than a bottle would.

The present invention provides the benefits associated with using the stand-up flexible pouch for pourable liquids, e.g., wine, and pourable solids, while mitigating the difficulties described above. The dispenser of the present invention overcomes the consumers' aesthetic hurdle of accepting the flexible pouch as a viable, everyday package alternative to traditional glass packaging by adding an attractive exterior carafe and a functional locking mechanism that make daily use simple. It will be appreciated by those skilled in the art that substitutions and modifications to the above can be made without departing from the spirit or scope of the invention.

SUMMARY OF THE INVENTION

A dispenser is provided for containing and dispensing a liquid or pourable solid product. The dispenser includes a shell having a bottom and a continuous side wall, which together define a hollow cavity. A lid assembly covers the rigid shell and includes a central opening. A flexible pouch is arranged for locating within the hollow cavity and for containing the product to be dispensed. The flexible pouch includes a pouring spout having an outlet opening. The pouring spout is arranged for extending through the lid assembly opening when the flexible pouch is situated within the hollow cavity. The lid assembly additionally includes a set of clamping members positioned to surround the pouring spout. The clamping members are responsive to actuation and arranged to move from a retracted position to a clamping position to retain the pouring spout within the opening during dispensing.

BRIEF DESCRIPTION OF THE DRAWINGS

FIG. 2 is a cross-sectional view taken along line 2-2 of FIG. 1 illustrating the clamping members of the first embodiment of the present invention in the clamping position;

FIG. 3 is a cross-sectional view similar to FIG. 2 illustrating the clamping members of the first embodiment of the present invention in the retracted position;

DETAILED DESCRIPTION OF THE INVENTION

Figure 1:
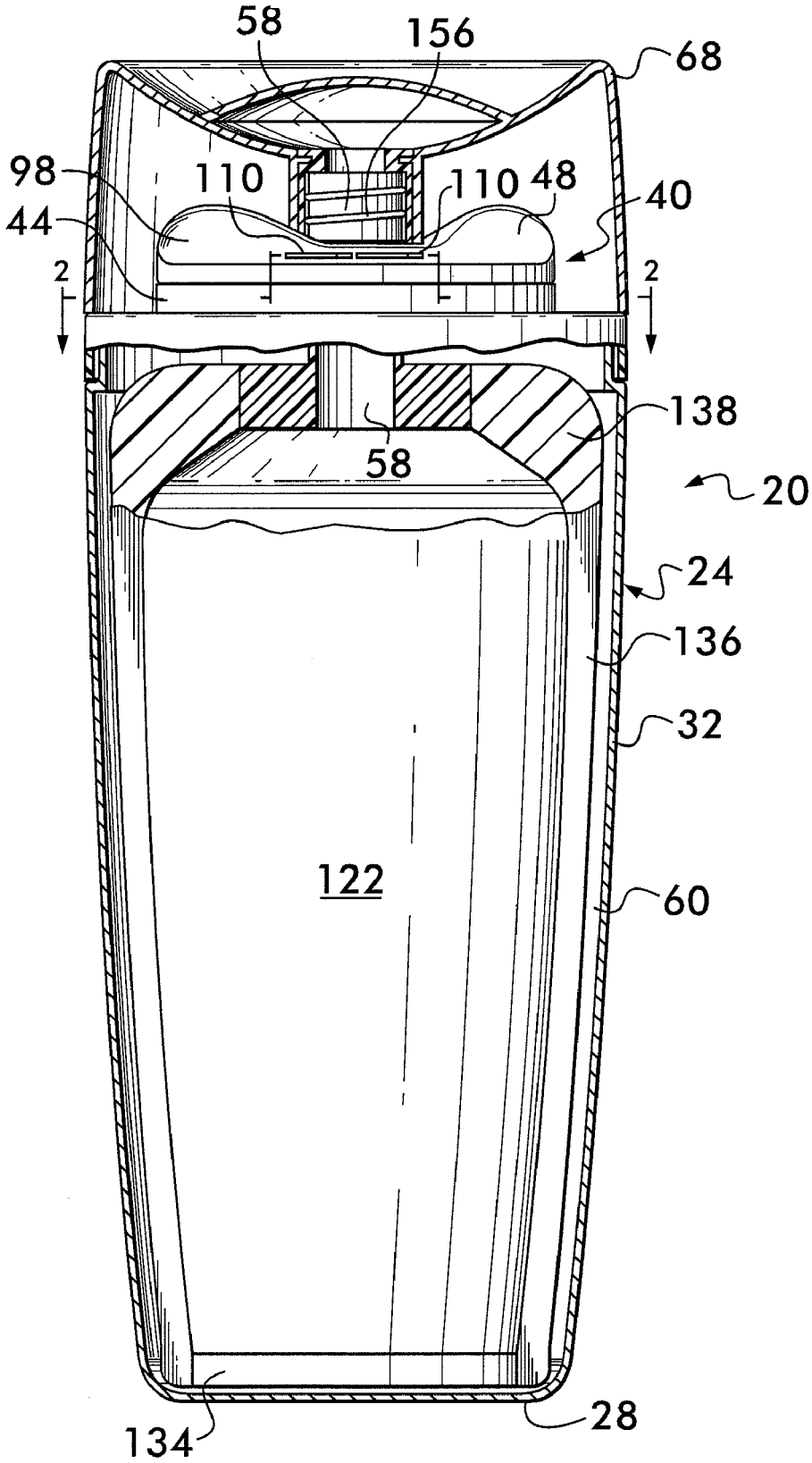
FIG. 1 is an elevational view, partially in section, of a first embodiment of the present invention.

Referring now in detail to the various figures of the drawings wherein like reference characters refer to like parts, there is shown at 20 in FIGS. 1 through 6, a first embodiment of the dispenser for containing and dispensing a liquid or pourable solid of the present invention. The dispenser includes a rigid or alternatively, soft exterior shell, which takes the form of carafe 24. The carafe 24 includes an integral bottom 28, a continuous sidewall 32, and an open top 36 (FIG. 6) to which a removeable lid assembly 40 is arranged for tight fastening thereover. Optionally, the carafe 24 may be formed of a material that provides sufficient insulation to enable a liquid or pourable solid product contained therein, e.g., wine or coffee, to retain its chilled or heated temperature for an extended period of time.

Figure 5:
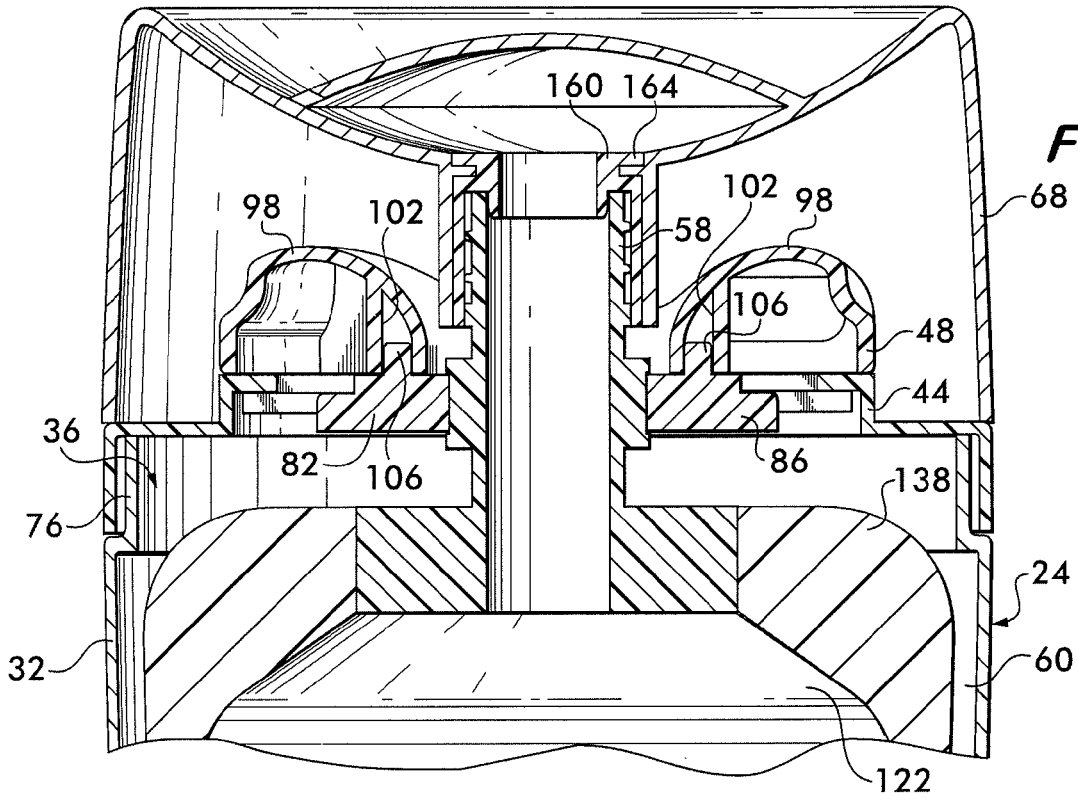
FIG. 5 is a cross-sectional view taken along line 5-5 of FIG. 4.
Figure 6:
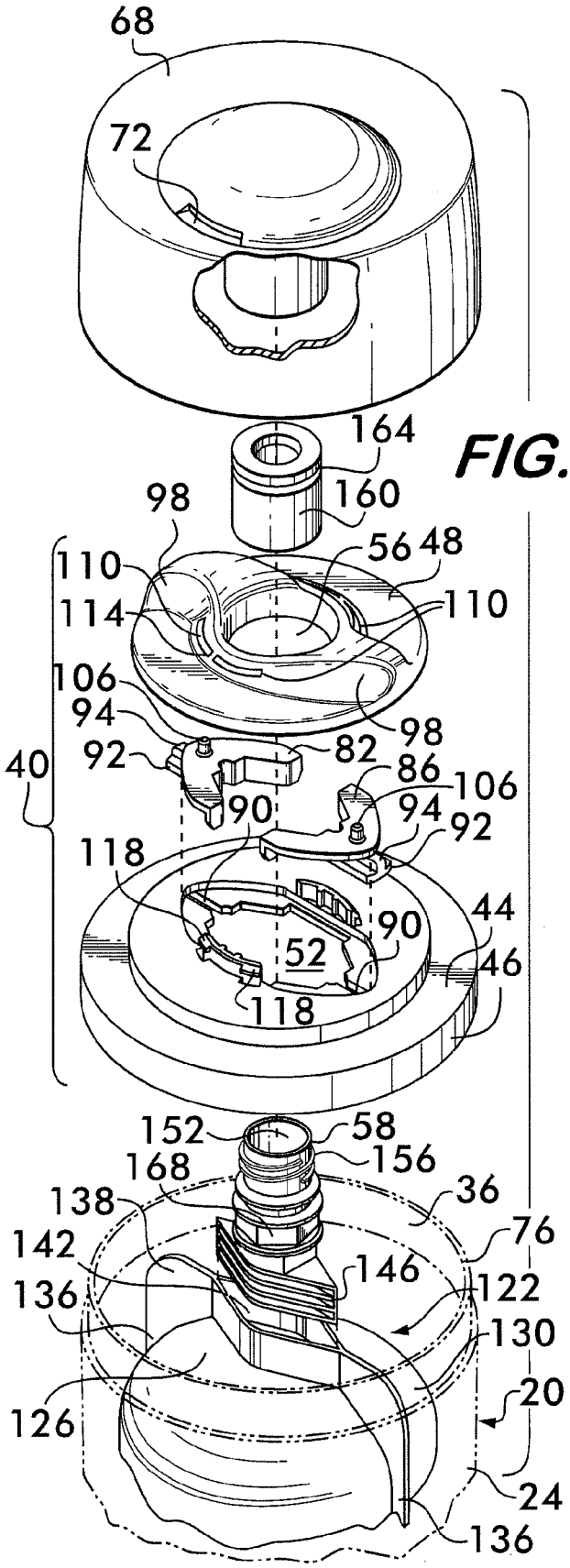
FIG. 6 is an exploded perspective view of the upper portion of the first embodiment of the present invention.

Referring now to FIGS. 5 and 6, the lid assembly 40 includes a lid base 44 and an actuator member 48 arranged to be positioned thereon for moving a pair of clamping members 82, 86 located within the lid base 44 between a retracted and a clamping position. The lid base 44 includes a central opening 52 and the actuator member 48 also includes a central opening 56, the central openings being coaxial and sized to allow for the passage of a pouring spout 58 therethrough. The pouring spout 58 may comprise a polyolefin or polyolefin copolymer. Other suitable materials may be employed to form the pouring spout 58.

Figure 4:
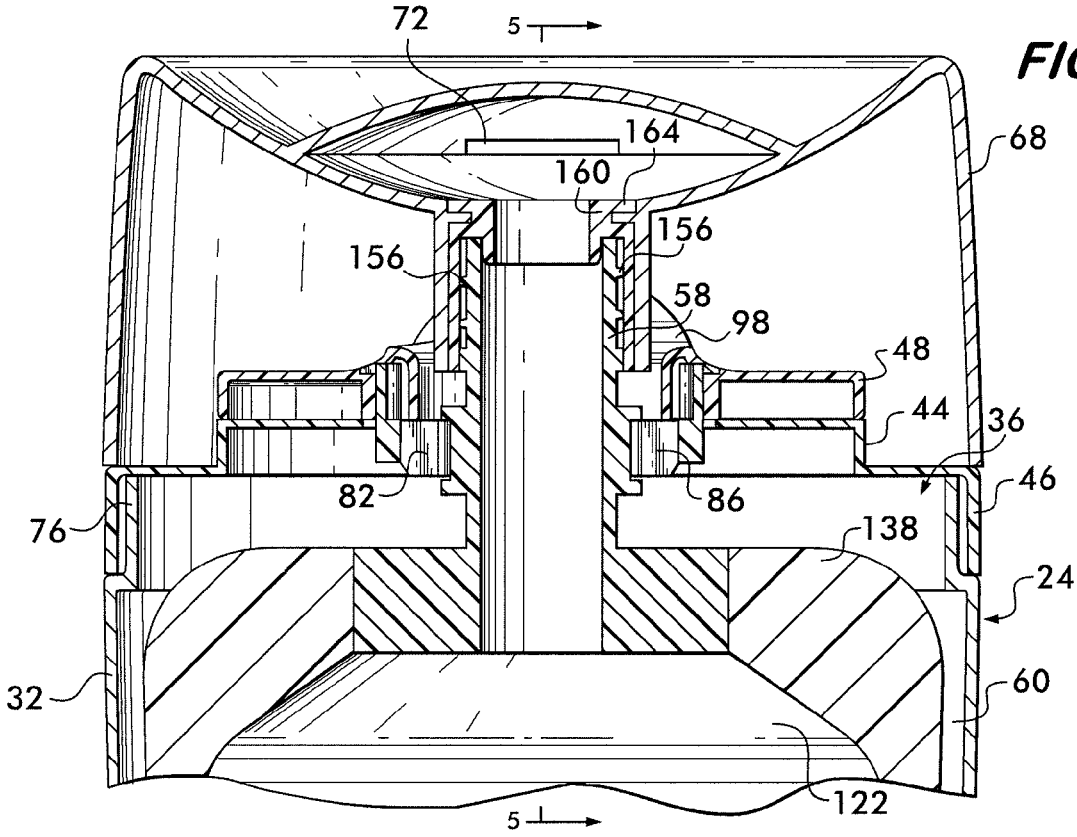
FIG. 4 is a cross-sectional view taken along line 4-4 of FIG. 2.

The carafe 24 is provided with an internal cavity 60 (FIG. 1) for storage of a flexible pouch 122 therein, the flexible pouch 122 arranged for storing and dispensing therefrom a liquid or pourable solid product (not shown in this embodiment). In accordance with the present invention, the liquid or pourable solid product could be a comestible product, e.g., a wine, or coffee, etc., or could be any other suitable product, e.g., motor oil. As best shown in FIGS. 4 and 6, the flexible pouch 122 includes the pouring spout 58 which extends upwardly through the central openings 52 and 56 of the lid base 44 and actuator member 48 when the lid assembly 40 is affixed to the open top 36 of the carafe 24. A closure 68 includes a fitment 160. The fitment 160 includes an annular shoulder 164 for snap-fitting attachment to the closure 68. As best shown in FIG. 4, the fitment 160 also includes a smooth interior surface to enable the closure 68 to be screwed down onto the threads 156 of the spout 58 for a leak-tight fit. The closure 68 includes a dispensing opening 72 through which the liquids or pourable solid products are dispensed during pouring.

The carafe 24 can be made from a wide variety of materials as well as assume a wide variety of shapes. For example, the carafe 24 may be formed of a high index plastic, aluminum, stainless steel, ceramic, glass, a hard wood, rubber, silver-plaged steel, gold-plated steel, or a polycarbonate material. Alternatively, the carafe 24 could be formed of a soft material, e.g., polyethylene terephthalate (PET), thus rendering the carafe 24 squeezable, but yet rigid enough to be easily gripped. Other suitable materials for the carafe 24 are also contemplated by the invention. The carafe 24 could be formed of multiple layers, e.g., a double wall formed of aluminum and PET. The carafe 24 may have a rectangular, square, oval, or circular cross-section. The exemplary carafe shown in FIGS. 1-6 is circular in cross-section. As best shown in FIGS. 4-6, in proximity to the open top 36 of the carafe 24, the sidewall 32 includes an annular indented lip 76. The lid base 44 includes an annular shoulder 46 arranged to fit over the indented lip 76.

Figure 7:
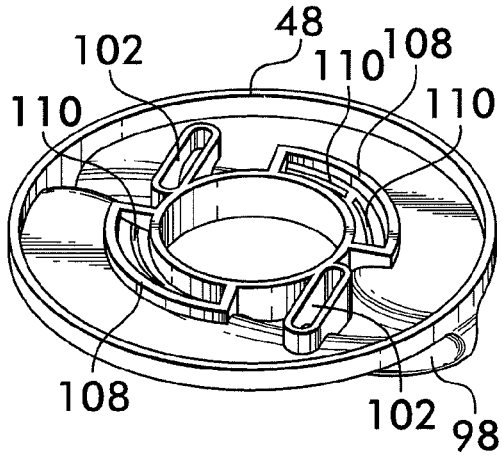
FIG. 7 is a perspective view of the underside of the actuator member of the first embodiment of the present invention.

Referring again to FIGS. 4 and 6, the actuator member 48 is arranged to be disposed over the lid base 44. Disposed within the central opening 52 of the lid base 44 is a set, e.g., a pair, of clamping members 82, 86 arranged to move between a retracted position and a clamping position. The clamping members 82, 86 are arranged for positioning and retaining the pouring spout 58 within the central opening 52 of the lid base 44. More specifically, as best shown in FIG. 6, the central opening 52 of the lid base 44 includes a pair of opposed channels 90. Each clamping member 82, 86 includes a base portion 92 including an upstanding tab 94 to enable the clamping member 82, 86 to travel within one of the channels 90 between the retracted and clamping positions for the purpose described above. The actuator member 48 is arranged to be seated on the lid base 44 and is arranged to rotate in response to manual actuation. To facilitate manual actuation, the actuator member 48 includes a set, e.g., a pair, of raised turns 98 on the top surface thereof. The raised turns 98 are arranged to be actuated by a user's thumb and forefinger on one hand. Referring now to FIG. 7, there is best illustrated therein the underside of the actuator member 48 wherein the actuator member 48 is shown to include a pair of straight elongated slots 102. Also, as shown in FIG. 6, each clamping member 82, 86 includes an upstanding pin 106. When the actuator member 48 is seated on the lid base 44, the upstanding pin 106 of each clamping member 82, 86 is arranged to extend within one of the straight elongated slots 102 on the underside of the actuator member 48.

FIGS. 2, 3 and 5 best illustrate the pin 106 of each clamping member 82, 86 extending within one of the straight elongated slots 102 on the underside of the actuator member 48. When the actuator member 48 is rotated by manual actuation, the upstanding pins 106 of the clamping members 82, 86 are caused to travel along the length of the straight elongated slots 102 on the underside of the actuator member 48 from one end to the other. This, in turn, causes the clamping members 82, 86 to travel within the opposed channels 90 between the retracted and clamping positions. When in the clamping position, the clamping members 82, 86 properly position and retain in place the pouring spout 58 extending through the central openings 52, 56 of the lid base 44 and actuator member 48. FIGS. 2 and 3 show the relative position of the pins 106 within the straight elongated slots 102 as the clamping members 82, 86 (shown in phantom in FIGS. 2 and 3) move between the retracted (FIG. 3) and clamping (FIG. 2) positions.

Referring now to FIGS. 6 and 7, the actuator assembly 48 also includes a set, e.g., a pair, of curved slots 108. As best shown in FIG. 7, the curved slots 108 are located on the underside of the actuator member. Each curved slot 108 includes a set, e.g., a pair, of curved openings 110, with a stop 114 located between the pair. The curved openings 110 of each slot 108 of the actuator member 48 are best shown as being situated next to each other and each includes two opposite ends and a finite curved length therebetween. As best shown in FIG. 6, the lid base 44 is provided with sets, e.g., two pairs, of radially extending prongs 118, each prong being is arranged to extend through one of the curved openings located on the actuator member 48 and to travel the length of the curved opening 110 between the two opposite ends. Upon rotation of the actuator member 48, the curved openings 110 travel with respect to the relatively stationary prongs 118 extending therethrough. In this manner, rotation of the actuator member 48 is limited by the length of travel of the curved openings 110. Referring now to FIGS. 2 and 3, these drawings illustrate the relative position of the prongs 118 within the curved openings 110 as the clamping members 82, 86 (shown in phantom in these figures) are moved from the clamping position (FIG. 2) to the retracted position (FIG. 3).

Referring now to FIG. 1, the flexible pouch 122 is arranged to be disposed within the internal hollow cavity 60 of the carafe 24. The flexible pouch 122 may be waterproof, and is formed of a generally pliable or plastic material for holding the liquid or pourable solid to be dispensed. As an example, the flexible pouch 122 may include a volume configured to receive a minimum of 500 milliliters, or one or two liters of a liquid or a pourable solid product. As best shown in FIG. 6, the flexible pouch 122 is formed of three sections including two sidewalls 126, 130 and a bottom wall 134 (FIG. 1). Referring again to FIG. 6, the side walls 126, 130 comprise two sections of pliable plastic which may be heat sealed along two vertical edges 136 and a top edge 138. At their bottom edges, the side walls are heat sealed to an edge of the bottom wall 134 (FIG. 1), forming a gusset in the bottom of the flexible pouch 122 to enable the flexible pouch 122 to stand on its own, with or without a liquid or pourable solid product stored therein.

As best shown in FIG. 6, located centrally along the top edge of the flexible pouch 122 is an opening 142. At its bottom most portion, the pouring spout 58 includes an annular flange 146 which is arranged to be disposed within the opening 142. The annular flange 146 is provided for heat sealing, adhesively connecting, or otherwise attaching the flexible pouch 122 thereto to form an integral unit, the pouring spout 58 in turn, forming a dispensing outlet for the contents of flexible pouch 122. As mentioned above, the flexible pouch 122 and pouring spout 58 are so connected into the internal cavity 60 of the carafe 24 that the pouring spout 58 will be disposed exterior of the open top 36 of the carafe 24 to enable detachable connection of the closure 68 to the pouring spout 58.

The flexible pouch 122 may be a multilayer film, for example a co-extruded or laminated film, each layer being selected from a group of suitable materials, e.g., polyethylene, aluminum, polyester, PET, or polypropylene. The layers may be heat-sealed to each other and may comprise any number of layers, e.g., four layers, and may include one or more barrier layers to decrease the permeability of atmospheric oxygen or to retard the loss of flavors, aromas, perfumes and other organic species from the product contained in the flexible pouch 122. Additional adhesive layers or tie layers may also be present to aid in bonding dissimilar layers to one another. Alternatively, the flexible pouch 122 may be formed of a material suitable for containing a product which has been heated by microwaving, e.g., hot coffee. In this manner, the flexible pouch 122 containing the hot product may be placed into the carafe 24 to avoid handling the heated product.

As best shown in FIGS. 1-6, the pouring spout 58 extends upwardly from the flexible pouch 122. Referring now to FIG. 6, the pouring spout 58 comprises an elongated, generally annular shaft having an inlet opening (not shown in FIG. 6) which extends into the flexible pouch 122 and a dispensing outlet 152, and is configured for extending upwardly from the flexible pouch 122.

The embodiment illustrated in FIGS. 1-6 is top loading. Referring now to FIG. 1, to load a flexible pouch 122 into the carafe 24, the closure 68 is first removed from the carafe 24 to expose the lid assembly 40 including the actuator member 48. The actuator member 48 is then rotated to cause the clamping members 82, 86 to move to the retracted position. Next, the lid assembly 40 is removed from the carafe 24 thus exposing the open top 36 and internal cavity 60 of the carafe 24. The flexible pouch 122, loaded with a liquid or pourable solid product to be dispensed, is then lowered through the open top 36 of the carafe 24 into the internal cavity 60 therein. As best shown in FIG. 4, when the flexible pouch 122 is inserted and situated within the internal cavity 60, the pouring spout 58 extends above the open top 36 of the carafe 24. The lid assembly 40 is then reattached to the open top 36 of the carafe 24 with the pouring spout 58 extending through the central openings 52 and 56 of the lid base 44 and actuator member 48. Since the clamping members 82, 86 have been moved to the retracted position, the central opening 52 in the lid base 44 is sufficiently large to allow for the passage of the pouring spout 58 therethrough. Likewise, the central opening 56 of the actuator member 48 is also sufficiently large to allow for passage of the pouring spout 58 therethrough.

Once the spout 58 is properly positioned and oriented within the opening 52 of the lid base 44, the actuator member 48 is then manually rotated causing the clamping members 82, 86 to move from the retracted position to the clamping position. The clamping members 82, 86 move along the channels 90 in the lid base 44 between the retracted and clamping positions to retain the spout 58 within the opening 52. It will be appreciated that other methods and mechanisms for attaching the pouch 122 to the carafe 24 are comprehended by the invention. What is important is that the spout 58 be fixed in place so that the user can pour product from the flexible pouch 122 by tipping the carafe 24.

Referring now to FIGS. 4 and 6, to ensure that the pouring spout 58 has been secured at the proper location and in the proper orientation between the clamping members 82, 86, the pouring spout 58 is provided with a hexagonal portion 168 located along its length just below the external thread 156. The clamping members 82, 86 are provided with complementary inner surfaces which are provided to engage the hexagonal outer surface of this portion 168 of the pouring spout 58. The result is that if the flexible pouch 122 is improperly oriented, proper clamping will not take place. It should be understood that in accordance with the invention, the portion 168 of the pouring spout 58 may be hexagonal or may be any other suitable geometric shape that enables an interlocking relationship between the pouring spout 58 and the clamping members 82, 86. For example, the portion 168 could be octagonal, polygonal, triangular, square or notched in shape, and the clamping members 82, 86 could be provided with complementary inner surfaces to achieve the interlocking relationship between the pouring spout 58 and the clamping members 82, 86.

Once the pouring spout 58 is properly retained by the clamping members, the closure 68 may be screwed down onto the pouring spout 58 to cover the lid assembly 40. Thereafter, the liquid or pourable solid product can be poured from the flexible pouch 122 by tipping carafe 24 to enable the product to travel from the flexible pouch 122 through the spout 58 and out the dispensing opening 72. Once the flexible pouch 122 has been emptied of its contents, it may be removed by first removing the closure 68, and rotating the actuator member 48 to cause the clamping members 82, 86 to move to the retracted position. The lid assembly 40 may then be removed from the carafe 24 and the empty flexible pouch 122 removed from the internal cavity 60. The embodiment described at 20 may be arranged as a single-use beverage container in that the carafe 24 and flexible pouch 122 may be sized to contain a liquid which would be consumed in a single use. For example, the flexible pouch 122 could be sized to contain approximately 500 milliliters of a wine, juice, water, or coffee, etc.

Figure 9:
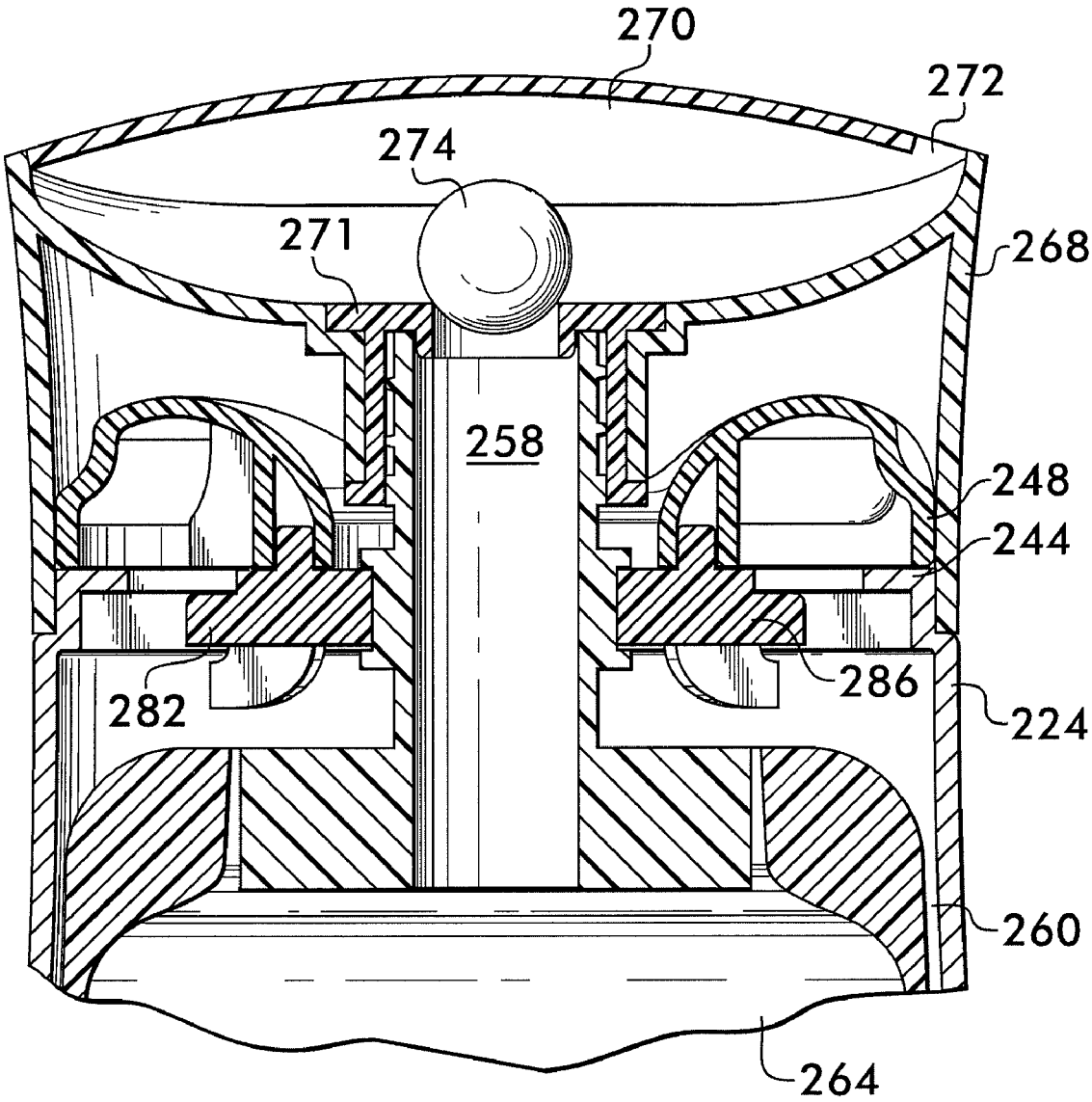
FIG. 9 is an enlarged elevational view, partially in section, of the upper portion of the second embodiment of the present invention shown in the upright position.
Figure 10:
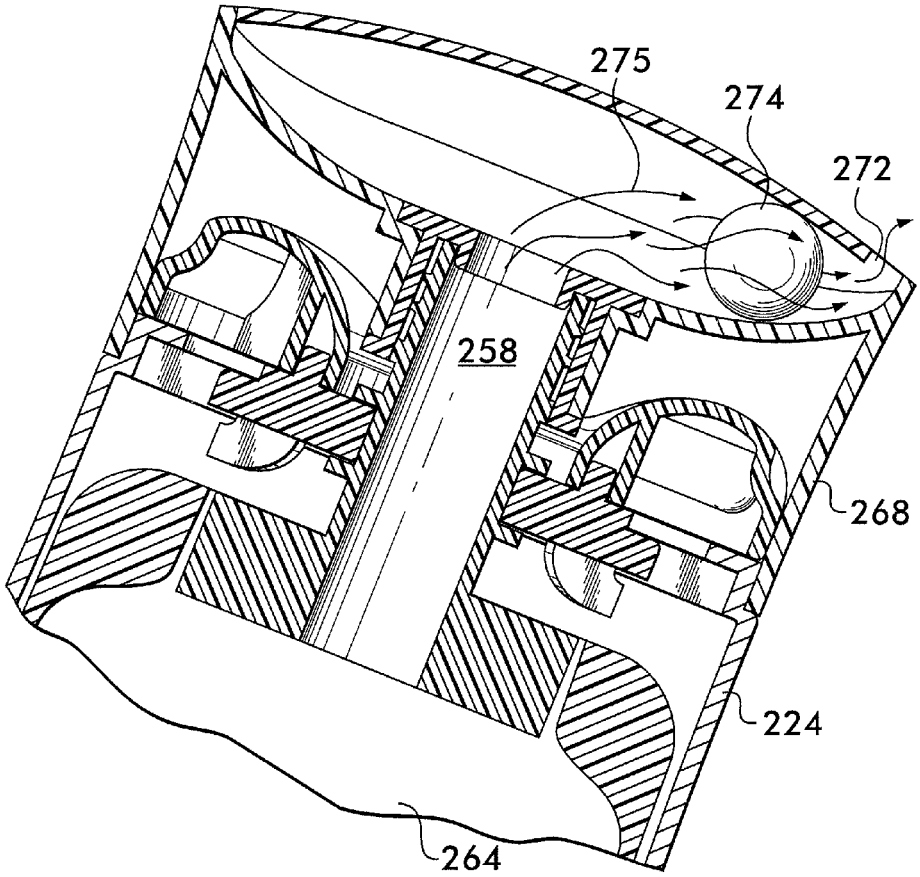
FIG. 10 is an enlarged elevational view, partially in section, of the upper portion of the second embodiment of the present invention shown in a tilted position for pouring.
Figure 11:
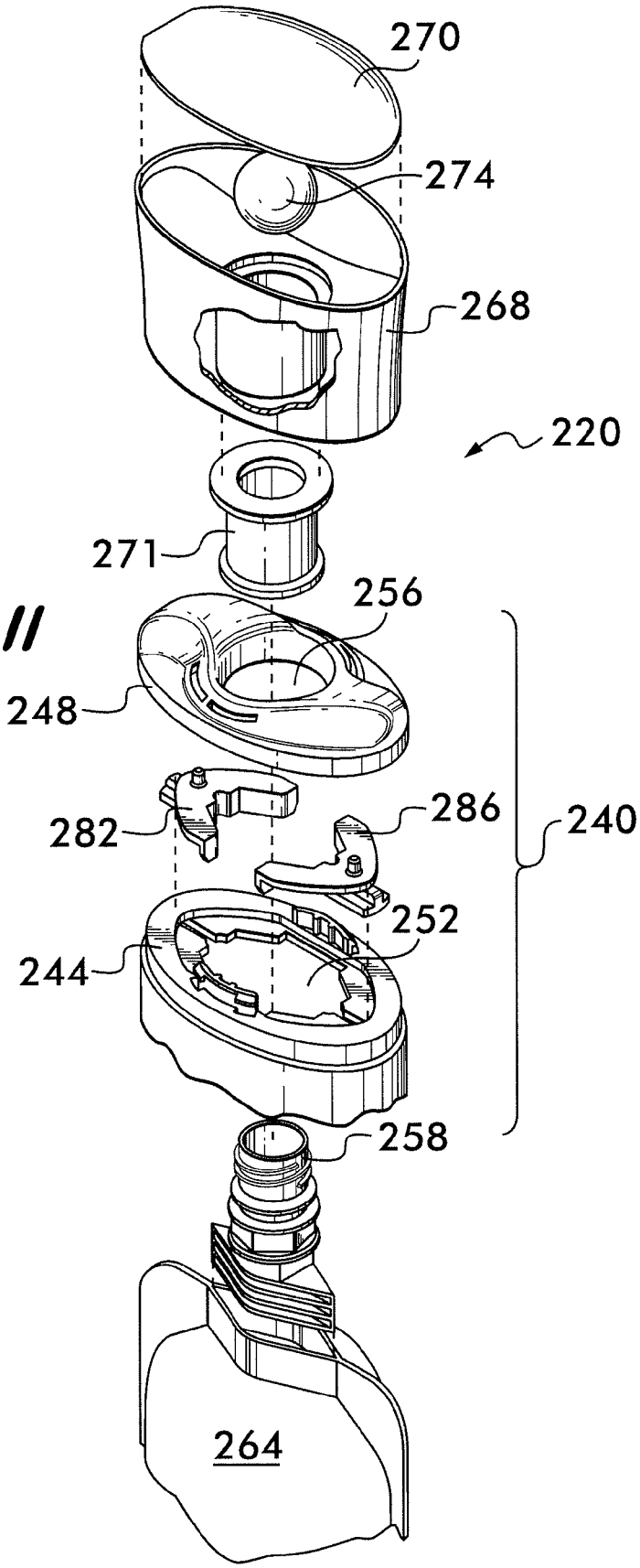
FIG. 11 is an exploded perspective view of the second embodiment of the present invention; and, FIG. 12 is an enlarged elevational view, partially in section, of the upper portion of a third embodiment of the present invention.

Referring now to FIGS. 8 through 11, there is shown a second embodiment 220 of the present invention. The second embodiment 220 also includes a rigid or soft exterior shell 224, the shell 224 including a base 228 that is releasably connected to the shell 224 to create an access opening at the bottom of the shell 224. For example, the base 228 may be snap-fitted to the bottom of the shell 224 or the bottom of the shell may be externally threaded for receiving an internally threaded base 228. The shell 224 also includes a continuous sidewall 232, and a lid assembly 240 (FIG. 11) located at the top of the shell 224. Referring now to FIG. 11, it should be understood that the manner of operation of this embodiment 220 is similar to that of the embodiment shown at 20 in that the lid assembly 240 of this embodiment includes a lid base 244 and an actuator member 248 for causing clamping members 282 and 286 to move between retracted and clamping positions to retain a pouring spout 258 for pouring a liquid or pourable solid product from a flexible pouch 264 retained within an internal cavity of the shell 224.

The materials of construction of the embodiment 220, including the flexible pouch 264, the shell 224, the lid assembly 240 and the closure 268, etc., are similar to the corresponding components of the embodiment 20. The embodiment 220 may have a rectangular, square, oval, or circular cross-section. The embodiment as shown in FIGS. 8-11 includes an oval cross-section. Also similar to the first embodiment 20, the embodiment 220 is provided with a closure 268 which includes a fitment 271 snap-fitted therein. The closure 268 is arranged to screw down onto the externally threaded pouring spout 258 and cover the lid assembly 240. The fitment 271 includes a central opening to provide open communication between the closure 268 and the pouring spout 258. Under this embodiment 220, the closure 268 also includes a removeable cover 270 (FIG. 11) which defines a hollow cavity within the closure 268, the hollow cavity housing a ball 274 within the closure 268.

Figure 8:
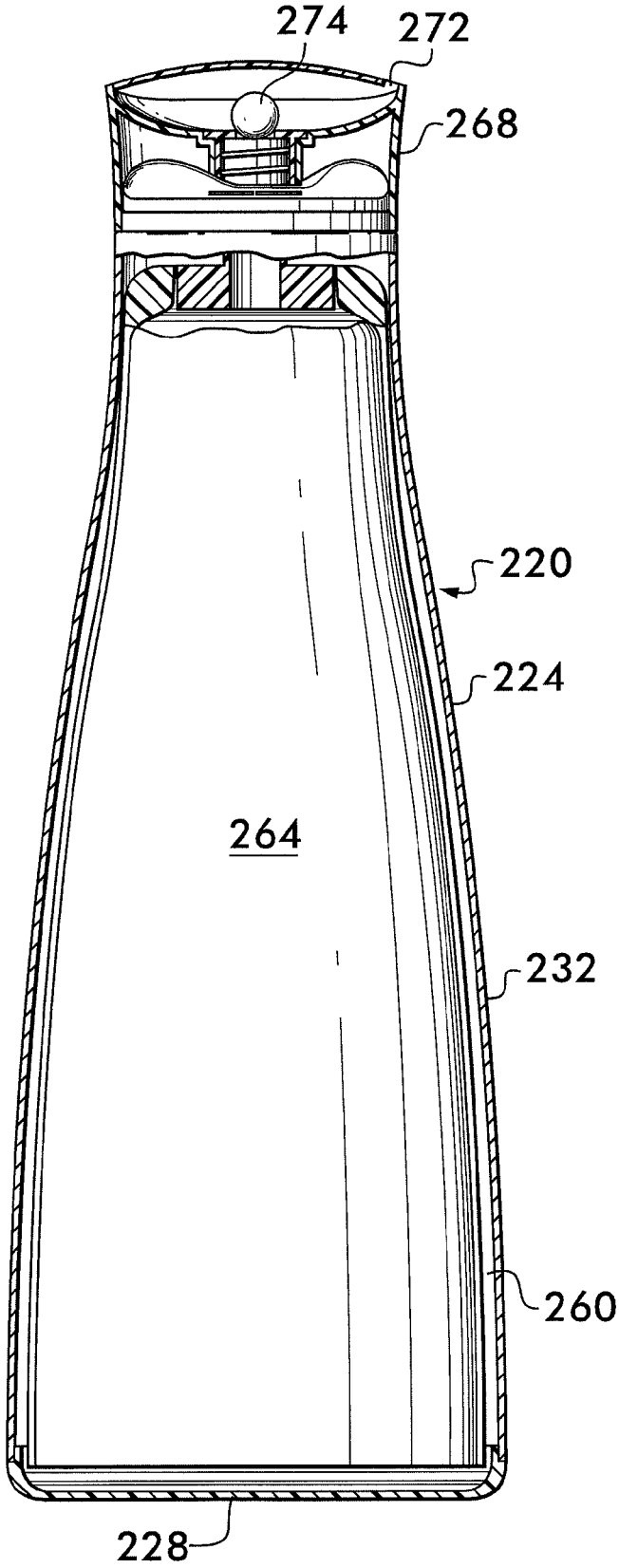
FIG. 8 is an elevational view, partially in section, of a second embodiment of the present invention.

There are some important differences between the embodiment 220 and the embodiment 20. First, as best shown in FIGS. 9 and 11, in the embodiment 220, the lid assembly 240 is shown as being integral with the shell 224, as opposed to being removeable therefrom as under the first embodiment 20. Second, as best shown in FIG. 8, the embodiment 220 includes the removeable base 228, as opposed to the integral bottom 28 of the shell 24 of the embodiment 20. Thus, the embodiment 220 is arranged for the flexible pouch 264 with pouring spout 258 integral therewith, to be loaded through the bottom of the shell 224 once the base 228 has been removed, as opposed to the top loading embodiment of 20. It should be understood that it is within the scope of this invention for each of the embodiments described herein to be arranged for either top loading or bottom loading. However, where larger flexible pouches are utilized for holding amounts of liquid and pourable solid products that are greater in weight and more difficult to handle, it is preferred that the embodiment be arranged to be top loading to facilitate the loading of such large pouches.

Referring now to FIG. 8, to load the flexible pouch 264 into the shell 224, the bottom 228 is first removed from the shell 224, thus exposing the internal cavity 260 of the shell 224. The flexible pouch 264, loaded with a liquid or pourable solid to be dispensed, is then inserted upwardly through the open bottom of the shell 224 into the internal cavity 260 therein. The actuator member 248 has been rotated to cause the clamping members 282, 286 to move to the retracted position to widen the central opening 252 of the lid base 244 sufficiently to enable insertion of the pouring spout 258 therethrough. The pouring spout 258 is inserted through the central openings 252 and 256 of the lid base 244 and actuator member 248, respectively. Once the flexible pouch 264 has been retained within the internal cavity 260 and the pouring spout 258 has been properly positioned, oriented and retained within the clamping members 282, 286, the bottom 228 may be reconnected to the bottom of the shell 224. Once the closure 268 is screwed down onto the pouring spout 258, liquid or a pourable solid product 226 may be poured from the flexible pouch 264.

As best shown in FIG. 9, the diameter of the ball 274 is larger than the central opening in the fitment 271 so that the ball 274 will not lodge within or fall through the fitment opening or pouring spout 258. The bottom portion of the closure 272 is sloped downwardly towards the fitment 271 in such a manner that when the embodiment 220 is placed in the upright position, the force of gravity causes the ball 274 to roll onto the opening in the fitment 271 to block entry of atmospheric air into the pouring spout 258, to retain freshness of the product stored within the flexible pouch 264. Referring now to FIG. 10, when the embodiment 220 is tipped from the upright position to a tilted position for pouring liquid or a pourable solid from the flexible pouch 264, the force of gravity causes the ball 274 to roll away from the opening in the fitment 271 and travel, e.g., roll, towards the dispensing opening 272 of the closure 268. The ball 274 is suitably large so that during pouring, the ball 274 will not pass through the dispensing opening 272 of the closure 268. During pouring, liquid or pourable solid product 275 exiting the dispensing end of the pouring spout 258 will flow around the ball 274 and out the dispensing opening 272 of the embodiment 220. Upon the completion of pouring the dispenser 200 is returned to the upright position and the ball rolls onto the opening in the fitment 271 to block entry of atmospheric air into the pouring spout 258.

By providing the ball 274 for blocking entry of atmospheric air into the pouring spout 258 after pouring, the freshness of the product remaining within the flexible pouch 264 will be maintained for later use. As such, the embodiment 220 is arranged for multiple uses as opposed to being a single-use device, as described in connection with the first embodiment 20. As such, a larger flexible pouch 264 may be utilized for storing larger amounts of liquid which may remain within the flexible pouch after the first use. For example, the shell 224 and flexible pouch 264 could be sized to contain at least approximately 1 liter of a liquid or pourable solid product therein.

Figure 12:
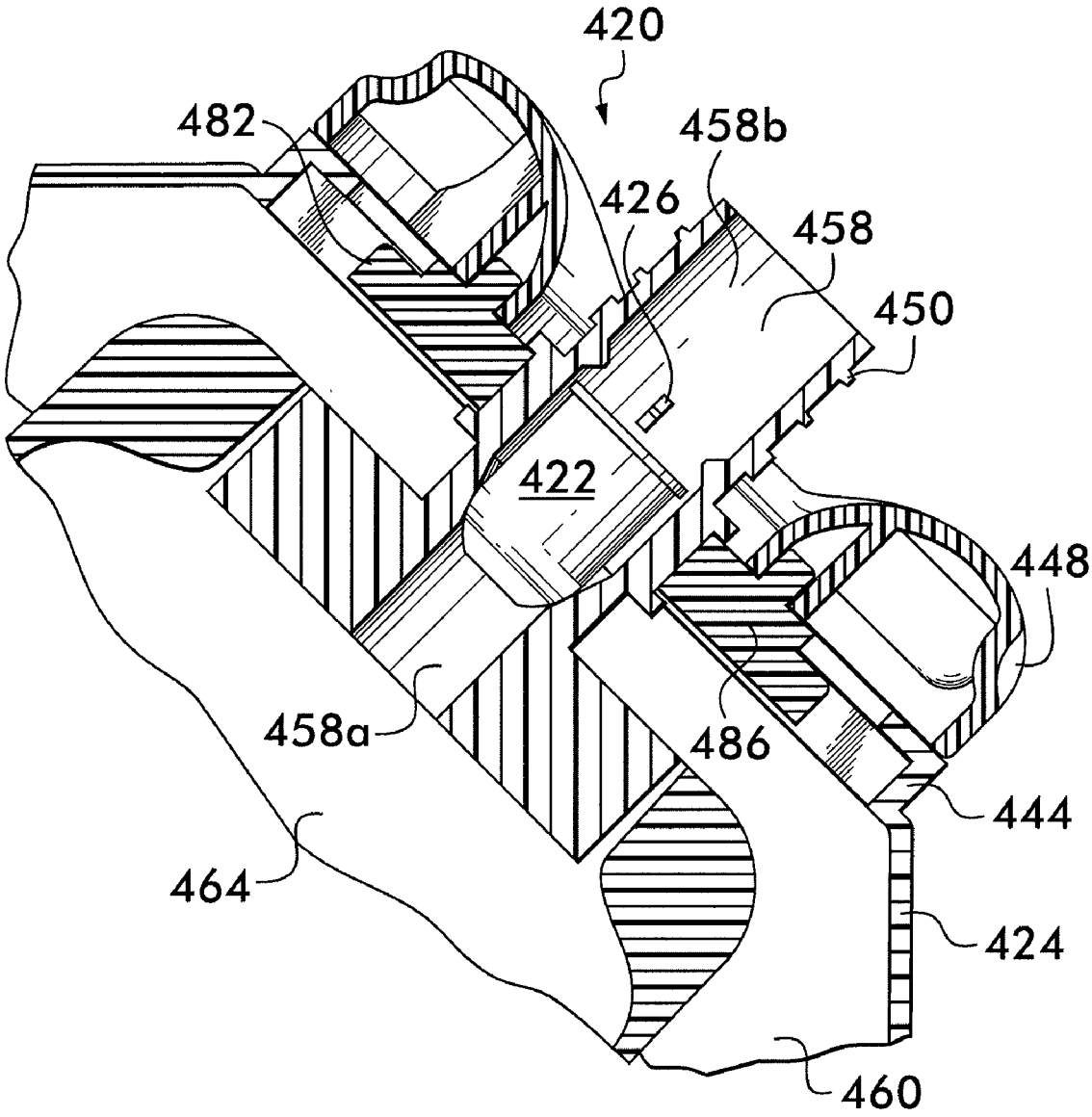

Referring now to FIG. 12, there is shown a third embodiment 420 of the present invention. The third embodiment 420 includes a rigid or soft exterior shell 424. Under this embodiment and similar to the embodiment 220, the shell 424 includes a base (not shown) that is releasably connected to the shell 424 to provide access for loading a flexible pouch 464 filled with a liquid or pourable solid product for dispensing. As described under the second embodiment 220, the base (not shown) may be snap-fitted to the bottom of the shell 224 or the bottom of the shell may be externally threaded for receiving an internally threaded base. The manner of operation of this embodiment 400 is similar to that of the embodiments shown at 20 and 220 in that the lid assembly of this embodiment includes a lid base 444 and an actuator member 448 for causing clamping members 482 and 486 to move between retracted and clamping positions to retain a pouring spout 458 for pouring a liquid or pourable solid product from a flexible pouch 464 retained within an internal cavity 460 of the shell 424. Under this embodiment 400, the lid base 444 and actuator member 448 are integral with the upper corner of the shell 424 and are oriented such that the pouring spout 458 retained therein is tilted at an approximately forty-five degree angle to facilitate pouring. A closure (not shown) is arranged to fit over the lid base 444 and actuator member 448 and screw down onto a thread 450 located on the external surface of the pouring spout 458. The closure (not shown) is similar in construction to the closure 68 as described in the first embodiment 20. The closure also includes a dispensing opening through which the liquids or pourable solid products are dispensed during pouring.

As best shown in FIG. 12, the pouring spout 458 includes an internal passageway that is formed of a narrower diameter portion 458*a* which opens to a wider diameter portion 458*b* going towards the dispensing end of the pouring spout 458. Situated within the internal passageway of the pouring spout 458 is a bullet-shaped plug 422 having an outer diameter which is sized to fit within the confines of the wider diameter portion but to prevent the plug 422 from passing through the narrower diameter portion 458*a*. It should be understood that although the plug 422 is illustrated as shaped as a bullet, other configurations could be utilized so long as they function to prevent the entry of air into the flexible pouch 464 which may compromise the freshness of the product stored therein.

In this manner, as shown in FIG. 12, when the embodiment 400 is situated in the upright position, the plug 422 remains seated over and completely covers the narrower diameter portion 458*a*, thus reducing the permeability of atmospheric oxygen into the flexible pouch 264 so as to not compromise the freshness of the product stored therein. When the embodiment 420 is tipped from the upright position to a tilted position for pouring liquid or a pourable solid from the flexible pouch 464, the plug 422 becomes unseated from the narrower diameter portion 458*a* and travels towards the outlet end of the pouring spout 458 until it is prevented from moving further by a plurality of stoppers 426 located and spaced equidistantly about the interior wall of the internal passageway of the pouring spout 458. In this manner, liquid or pourable solid product exiting the dispensing end of the pouring spout 458 will flow around the plug 422, out the outlet end of the pouring spout 458 and out the dispensing opening of closure (not shown).

By providing the plug 422 within the internal passageway of the pouring spout 458 to protect the product contained within the flexible pouch 464 between uses, like the second embodiment 220, the embodiment 420 is arranged for multiple uses. For example, the shell 424 and flexible pouch 464 could be sized to contain approximately 2 liters of a liquid or pourable solid product. Without further elaboration the foregoing will so fully illustrate my invention that others may, by applying current or future knowledge, adapt the same for use under various conditions of service.

I claim:

1. A dispenser for containing and dispensing a liquid or pourable solid product, said dispenser comprising:

a. a shell having a bottom, a continuous side wall, which together define a cavity;

b. a lid assembly disposed over said shell, said lid assembly including an opening; and, c. a flexible pouch located within said cavity and for containing the liquid or pourable solid product therein, said flexible pouch including a pouring spout in open communication with said pouch and having an outlet opening, said pouring spout arranged for extending through said lid assembly opening, said lid assembly additionally comprising a set of clamping members arranged for retaining said pouring spout within said opening, wherein each of said clamping members includes an arcuately shaped engaging surface for engaging said pouring spout outside surface.

2. The dispenser of claim 1, wherein said lid assembly additionally comprises an actuator arranged for moving said clamping members between said retracted and clamping positions, wherein said actuator includes a central opening through which said pouring spout is arranged to extend.

3. The dispenser of claim 1, wherein the engaging surfaces of said clamping members are contoured to fit a portion of the outer surface of said pouring spout.

4. The dispenser of claim 3, wherein said portion is hexagonal in shape.

5. The dispenser of claim 2, wherein each of said clamping members includes an upstanding resilient pin, and wherein said actuator includes a plurality of elongated channels each having a length, said pins being disposed within said channels so that upon manual rotation of said actuator, said pins travel along the length of said channels causing said clamping members to move between said retracted and clamping positions.

6. The dispenser of claim 5, wherein said elongated channels are disposed on the underside of said actuator.

7. The dispenser of claim 1, wherein said flexible pouch and said pouring spout are made from compatible materials for heat sealing to each other.

8. The dispenser of claim 1, wherein said bottom is releasably attached to said shell for insertion of said flexible pouch therethrough.

* * * * *